US008950072B2

(12) United States Patent
Kaneko et al.

(10) Patent No.: US 8,950,072 B2
(45) Date of Patent: Feb. 10, 2015

(54) METHOD OF MANUFACTURING A LIQUID EJECTION HEAD BY MOVING DISCHARGE MEMBERS

(75) Inventors: Toshiaki Kaneko, Tokyo (JP); Satoshi Kodama, Oita (JP); Hirotaka Miyazaki, Yokohama (JP); Satoshi Shimazu, Kawasaki (JP); Naoya Tsukamoto, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 78 days.

(21) Appl. No.: 13/486,446

(22) Filed: Jun. 1, 2012

(65) Prior Publication Data

US 2012/0305680 A1 Dec. 6, 2012

(30) Foreign Application Priority Data

Jun. 6, 2011 (JP) ..... 2011-126280

(51) Int. Cl.

| | |
|---|---|
| ***B21D 53/76*** | (2006.01) |
| ***B41J 2/045*** | (2006.01) |
| ***B41J 2/14*** | (2006.01) |
| ***B41J 2/16*** | (2006.01) |

(52) U.S. Cl.

CPC ..... *B41J 2/14072* (2013.01); *B41J 2/1601* (2013.01); *B41J 2/1623* (2013.01); *B41J 2002/14362* (2013.01)

USPC ..... 29/890.1; 29/611; 29/841; 29/854; 347/50

(58) Field of Classification Search

CPC ... B41J 2/1753; B41J 2/17559; B41J 2/17553

USPC ..... 29/890.1, 854–855, 841, 876, 611; 347/50, 58–59

See application file for complete search history.

(56) References Cited

U.S. PATENT DOCUMENTS

| | | | | |
|---|---|---|---|---|
| 6,084,612 | A * | 7/2000 | Suzuki et al. | 347/50 |
| 6,155,677 | A * | 12/2000 | Kitani et al. | 347/65 |
| 7,237,881 | B2 * | 7/2007 | Hayasaki et al. | 347/86 |
| 8,074,357 | B2 * | 12/2011 | Shimazu et al. | 29/890.1 |
| 8,272,130 | B2 * | 9/2012 | Miyazaki | 29/890.1 |
| 8,562,109 | B2 * | 10/2013 | Miyazaki et al. | 347/44 |
| 2008/0295332 | A1 * | 12/2008 | Shimazu et al. | 29/890.1 |

FOREIGN PATENT DOCUMENTS

JP 2008-296574 A 12/2008

* cited by examiner

*Primary Examiner* — Minh Trinh

(74) *Attorney, Agent, or Firm* — Canon USA Inc IP Division

(57) ABSTRACT

A method of manufacturing a liquid ejection head, which includes: preparing a liquid ejection head which includes: a recording element board provided with an ejection port through which liquid is ejected and an energy generator; an electrical wiring member provided with an opening from which the recording element board is exposed; and plural electrical connecting portions for electrically connecting the recording element board and the electrical wiring member relatively moving a discharge member, which is for dropping a sealing agent, toward one end of an arrangement of the electrical connecting portions while dropping the sealing agent onto the electrical wiring member and inside the opening; and relatively moving the discharge member from the one end of the electrical connecting portions to the other end while dropping the sealing agent to seal the electrical connecting portion.

7 Claims, 9 Drawing Sheets

PRIOR ART

PRIOR ART

PRIOR ART

METHOD OF MANUFACTURING A LIQUID EJECTION HEAD BY MOVING DISCHARGE MEMBERS

BACKGROUND OF THE INVENTION

1. Field of the Invention

The present disclosure relates to a liquid ejection head which carries out a recording operation by ejecting liquid, such as ink, and a method of manufacturing the liquid ejection head.

2. Description of the Related Art

A liquid ejection head which ejects liquid, such as ink, is consist of a recording element board and an electrical wiring tape. The recording element board is provided with ejection ports through which the liquid is ejected, liquid flow paths along which the liquid is supplied to the ejection ports, and an energy generator which generates energy that causes the ejection of the liquid.

In such a liquid ejection head, as illustrated in FIG. 7A, connecting points 204 at which a recording element board 201 and an electrical wiring tape 210 are electrically connected to each other is provided at both ends of the recording element board 201. The connecting points 204 are covered with a sealing agent 231 for the protection from liquid, such as ink, as illustrated in FIG. 7B. In the process of applying the sealing agent 231, as illustrated in FIG. 7C, portions 232 at which the amount of the applied sealing agent 231 is small (hereinafter, referred to as recesses 232) may be formed partially in the sealing agent 231. Formation of the recesses will be described with respect to FIGS. 8, and 9A to 9C. FIG. 8 is a schematic diagram illustrating a VIII-VIII cross section of FIG. 7A. As illustrated in FIG. 8, the electrical wiring tape 10 is disposed at a position higher than a recording element board 1. In this state, a needle 20 for applying a sealing agent is operated to scan and the sealing agent 31 is applied to electrical connecting portions. The needle is moved to scan positions 201, 202 and 203 in this order and apply the sealing agent. The sealing agent is applied to the electrical wiring tape 10 at the position 201, and is applied to the recording element board 1 at the position 203. At the position 202 which is a stepped portion formed between the electrical wiring tape 10 and the recording element board 1, the sealing agent discharged from the needle does not reach the recording element board 1. Since the sealing agent reaches the recording element board slowly at that position, the amount of the sealing agent at the portion is insufficient and the recess 232 is formed. Formation of the recess at the stepped portion between the electrical wiring tape 10 and the recording element board 1 is illustrated in perspective views in FIGS. 9A to 9C.

Japanese Patent Laid-Open No. 2008-296574 addresses the recess issue by increasing a gap L between the recording element board 1 and the electrical wiring tape 10 which faces the recording element board, as illustrated in FIG. 10. The increased gap L enables application of the sealing agent to side ends of the recording element board 1. Therefore, the sealing agent is applied so as not cause any insufficiency in the amount of the sealing agent applied to the recording element board 1.

However, the increased gap L requires a wider range in which the sealing agent is to be applied, and the amount of the sealing agent to be applied is increased. Further, the size of the liquid ejection head is increased corresponding to the increased application range of the sealing agent.

SUMMARY OF THE INVENTION

A method of manufacturing a liquid ejection head, which includes: preparing a liquid ejection head which includes: a recording element board provided with an ejection port through which liquid is ejected and an energy generator which produces energy that causes ejection of the liquid, an electrical wiring member provided with an opening from which the recording element board is exposed, and plural electrical connecting portions for electrically connecting the recording element board and the electrical wiring member, and in which the electrical wiring member is disposed at a position higher than a surface of the recording element board on which the ejection port is formed, the plural electrical connecting portions being arranged in a predetermined direction on the recording element board; relatively moving a discharge member, which is for dropping a sealing agent, toward one end of the arrangement of the electrical connecting portions while dropping the sealing agent onto the electrical wiring member and inside the opening; and relatively moving the discharge member from the one end of the arrangement of the electrical connecting portions to the other end while dropping the sealing agent from the discharge member to seal the electrical connecting portion.

Further features will become apparent from the following description of exemplary embodiments with reference to the attached drawings.

DESCRIPTION OF THE EMBODIMENTS

Figure 1:
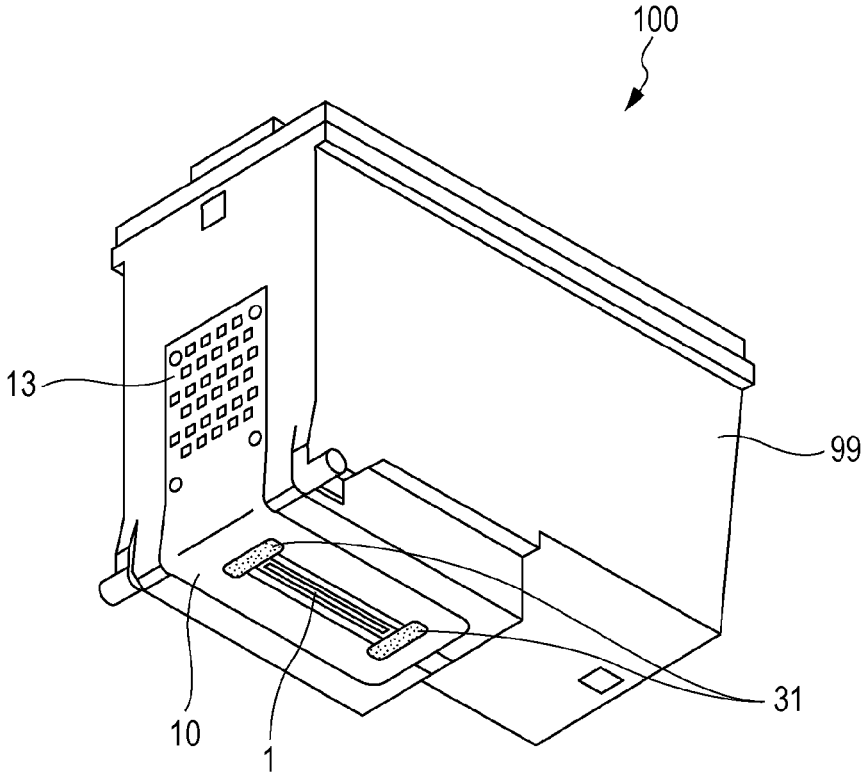
FIG. 1 is an exterior perspective view of a liquid ejection head according to the present embodiment.

An embodiment according to the present disclosure will be described with reference to the drawings. FIG. 1 is an exterior perspective view of a liquid ejection head to which the present invention may be applied. A liquid ejection head 100 of the embodiment according to the present invention is provided with an ink tank unit and a recording head unit which are integrated with each other. The liquid ejection head 100 is removably attached to a carriage which is a head-carrying member of an inkjet recording apparatus main body.

Each component of the liquid ejection head will be described hereinafter. A recording element board 1 is provided with two mutually facing sides and electrode sections 2 (see FIG. 3A). The electrode sections 2 are disposed along sides disposed between the two mutually facing sides and supply an energy generator with electric power. The recording element board 1 is also provided with ejection ports 3 through which liquid ink is ejected, an electrothermal transducer as an energy generator which generates energy that causes ejection of the liquid, and pieces of wiring for sending electrical signals and electric power for heat generation to the electrothermal transducer. The electrothermal transducer and the ejection ports 3 face each other.

An electrical wiring tape 10 as an electrical wiring member forms electric paths (i.e., wiring) along which electric power and electrical signals that causes ejection of the liquid are supplied from the inkjet recording apparatus to the electrode sections 2 of the recording element board 1. The electrical wiring tape 10 includes an opening 11 in which the recording element board 1 is attached and exposed. Pieces of lead-shaped electrical wiring 12 are formed at edges of the opening 11 and are made to extend inside the opening 11. The pieces of electrical wiring 12 are connected to the electrode sections 2 of the recording element board 1. The electrical wiring tape 10 also includes external signal input terminals 13 which are external wiring sections to receive electrical signals from an unillustrated main apparatus. The pieces of electrical wiring 12 and the external signal input terminals 13 are connected to each other by successive copper foil wiring patterns. The electrical wiring tape 10 in the present embodiment employs the Tape Automated Bonding (TAB) system.

The electrical wiring tape 10 and the recording element board 1 are electrically connected to each other by, for example, thermal ultrasonic bonding between bumps formed in the electrode sections 2 (see FIG. 3A) of the recording element board 1 and the pieces of electrical wiring 12 which are inner leads of the electrical wiring tape 10. Alternatively, gang bonding may be employed to achieve improved productive efficiency. In the gang bonding, the electrode sections 2 of the recording element board 1 are plated and the pieces of lead-shaped electrical wiring 12 of the electrical wiring tape 10 are collectively bonded with the plated electrode sections 2 with heat and pressure.

Figure 2A:
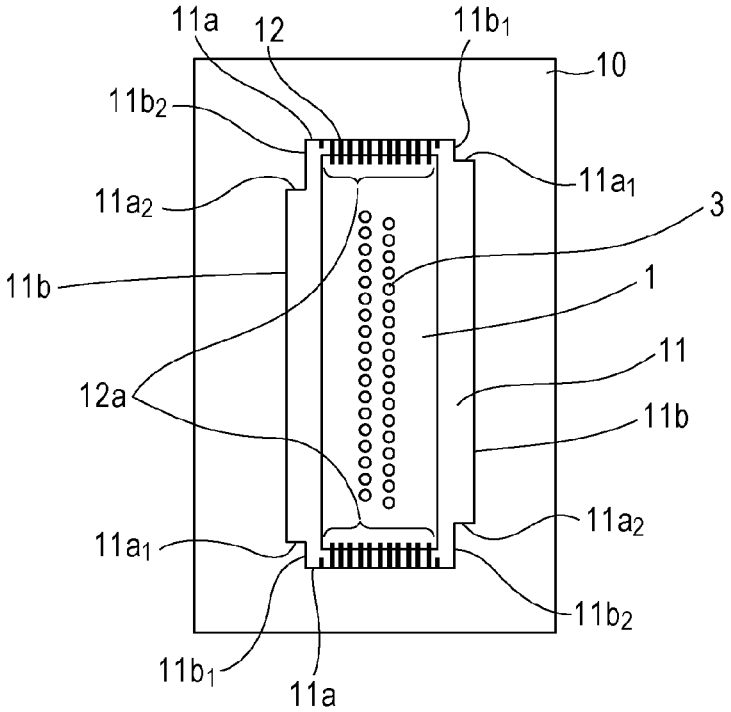
FIG. 2A and FIG. 2B are plan views illustrating an electrical wiring section of the liquid ejection head before and after the application of a sealing agent in a first embodiment.
Figure 3A:
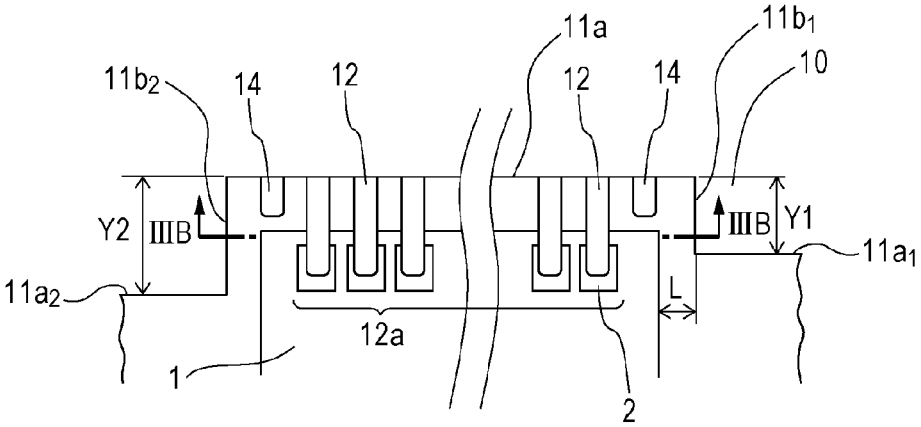
FIG. 3A is a partially enlarged plan view.
Figure 3B:
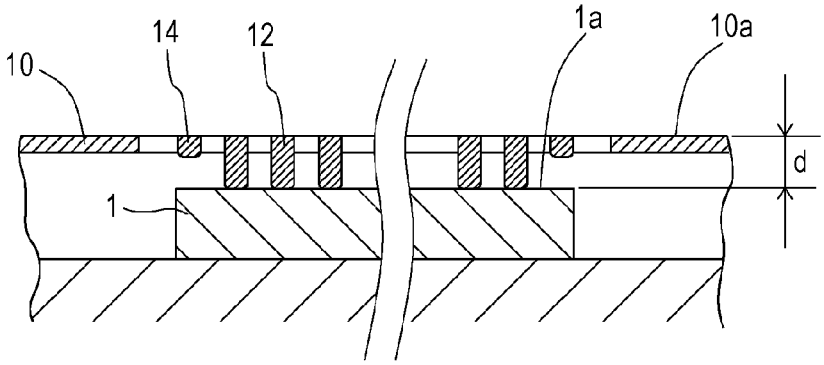
FIG. 3B is a sectional view of the electrical wiring section.

FIG. 2A is a plan view of electrical wiring sections of the liquid ejection head before the sealing agent is applied. FIG. 3A is a partially enlarged plan view of the electrical wiring sections illustrated in FIG. 2A. FIG. 3B is a cross-sectional view at an IIIB-IIIB position of FIG. 3A.

First, the shape of the opening 11 of the electrical wiring tape 10 and a relationship between the opening 11 and the recording element board 1 disposed in the opening 11 will be described in detail with reference to FIG. 2A. Edges of the electrical wiring tape 10 which surround the opening 11 include two mutually facing sides 11*a* and 11*a* and two sides 11*b* and 11*b*. The sides 11*b* and 11*b* face each other along the direction in which the sides 11*a* and 11*a* are connected to each other. Plural electrical connecting portions 12*a* consisting of plural pieces of electrical wiring 12 are disposed at predetermined positions at ends of the recording element board 1 along the sides 11*a* and 11*a*. The electrical connecting portions 12*a* may be ends of the recording element board 1 corresponding at least partially to the two sides 11*a* and 11*a*. The plural pieces of lead-shaped electrical wiring 12 arranged in rows protrude along the sides 11*a* and 11*a* at ends of the opening of the electrical wiring tape 10. The electrical connecting portions 12*a* are connecting points between the plural pieces of electrical wiring 12 arranged in a row and plural electrode sections 2 of the recording element board 1. Each electrical connecting portion 12*a* extends as a belt along an end of the recording element board 1 which faces the side 11*a*.

The sides 11*b* and 11*b* are disposed at ends of the recording element board and sandwich the recording element board 1. One of the sides 11*b* and 11*b* is a side 11$b_1$ and the other is a side 11$b_2$. That is, the edge of the electrical wiring tape 10 which surrounds the opening 11 is consist of first sides 11$b_1$ and second sides 11$b_2$. The first sides 11$b_1$ are disposed along the direction in which the two mutually facing sides 11*a* and 11*a* are connected to each other. The second sizes 11$b_2$ are disposed at the opposite side of the first sides 11$b_1$ via the recording element board 1 along the direction in which the two mutually facing sides 11*a* are connected to each other. The first sides 11$b_1$ and the second sides 11$b_2$ are individually disposed at positions on diagonal lines near the corner of the opening 11. As illustrated in FIG. 3A, a gap L exists between the side 11$b_1$ and the recording element board 1. In the present embodiment, it is desired that the width of the gap L is larger than 0.1 mm. If the gap L is 0.1 mm or narrower, the horn of a pressure bonding device used in the connection of the pieces of electrical wiring of the electrical wiring tape and the electrode sections of the recording element board may cause interference. Although the maximum width of the gap L is not particularly limited, 2 mm or narrower is desirable from the viewpoint of energy saving and an increase in production speed because excessively large gap increases the area in which the sealing agent is to be applied.

A relationship between the electrical wiring tape 10 and the recording element board 1 in the height direction will be described with reference to FIG. 3B. A surface of the recording element board 1 on which the ejection ports 3 are formed ("principal surface 1*a*") is disposed at a position higher than a principal surface 10*a* of the electrical wiring tape 10 on which the opening 11 is formed. Thus, a step d is formed between the principal surface 1*a* of the recording element board 1 and the principal surface 10*a* of the electrical wiring tape 10. The step d is formed to protect the ejection ports 3 from being damaged by, for example, collision with a recording medium.

In the present embodiment, the height of the step d is desirable in a range of not smaller than 0.05 mm and not larger than 0.5 mm. If the height of the step d is smaller than 0.05 mm, an effect of the existence of the step is impaired and therefore protection of the recording element board 1 is not achieved. If the height of the step d is excessively large, the distance between the ejection ports and the recording medium increases and thereby it is possible that the ejected liquid does not land on intended positions on the recording medium and fine images are not able to be obtained. Thus, it is desirable that the height of the step d is not larger than 0.5 mm.

Next, application of the sealing agent in the method of manufacturing the liquid ejection head will be described. Sealing agents of various hardening systems may be used. From the viewpoint of mobility and morphological stability, the sealing agent has viscosity at 25 degrees of not smaller than 150 Pa·s and not larger than 350 Pa·s, and preferably not smaller than 200 Pa·s and not larger than 300 Pa·s. The lower sides of the pieces of electrical wiring 12 may be sealed in advance with a sealing agent of lower viscosity.

Figure 2B:
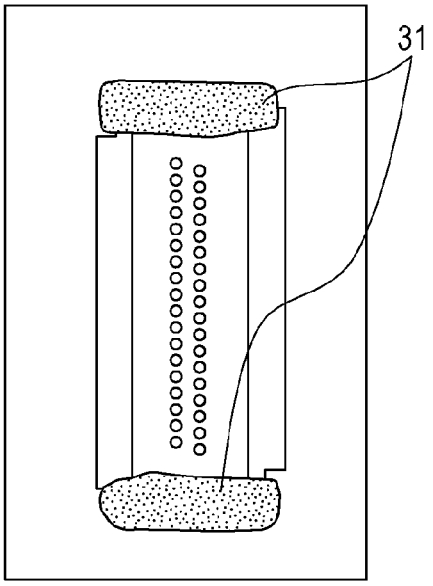
Figure 4:
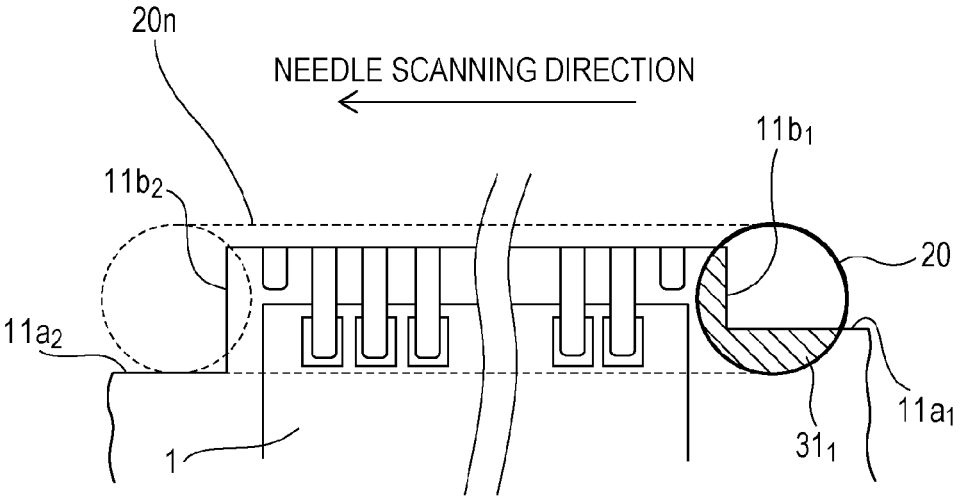
FIG. 4 is a plan view illustrating a locus of a needle which applies the sealing agent.
Figure 5:
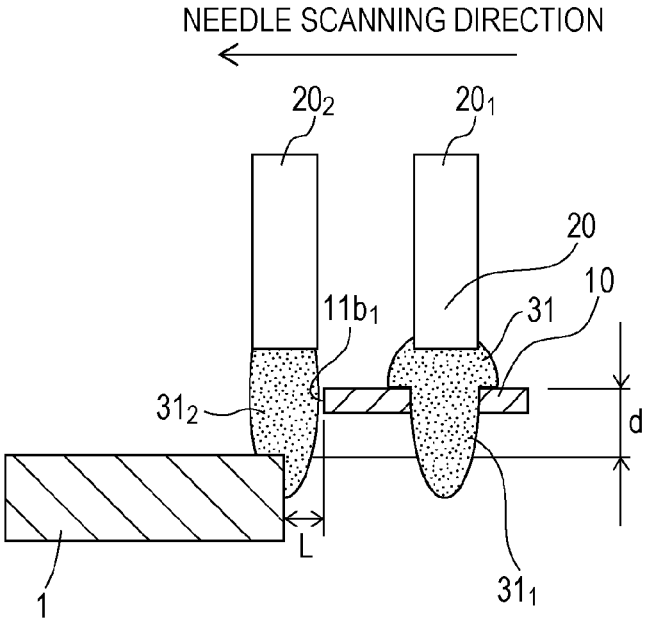
FIG. 5 is a diagram illustrating application of the sealing agent.

FIG. 2B is a plan view of the electrical wiring sections of the liquid ejection head after the sealing agent is applied in the present embodiment. A sealing agent 31 is applied by a needle 20 which is a member for discharging the sealing agent for the purpose of sealing the electrical connecting portion 12*a* as illustrated in FIGS. 4 and 5. The needle 20 is moved in the direction of the arrow while dropping the sealing agent to achieve the sealing. That is, the needle is moved to reach one end of the connecting portion while dropping the sealing agent and then continuously moved to the other end to complete the sealing. Although the needle is moved in this case, the needle may be fixed and the head may be moved such that the needle and the head are moved relative to each other. That is, application of the sealing agent is begun at the upper surface of the electrical wiring tape 10 (i.e., the principal surface 10*a*) at the side 11$b_1$ to reach the upper surface of the electrical wiring tape 10 (i.e., the principal surface 10*a*) at the side 11$b_2$ which faces the side 11$b_1$ passing above the step d and the gap L, and then above the electrical connecting portion 12*a*. Then, the sealing agent 31 is applied in the same manner to the other electrical connecting portion 12*a* at the opposite side 11*a*.

Figure 6A:
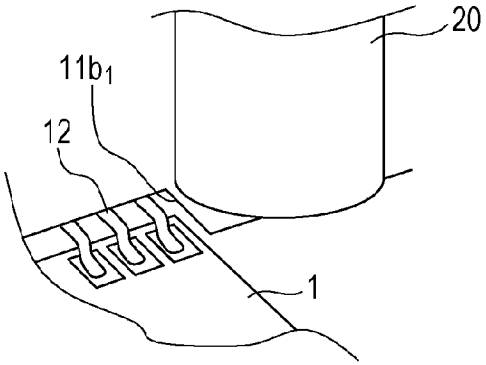
FIGS. 6A to 6C are perspective views illustrating steps of application of the sealing agent.
Figure 6B:
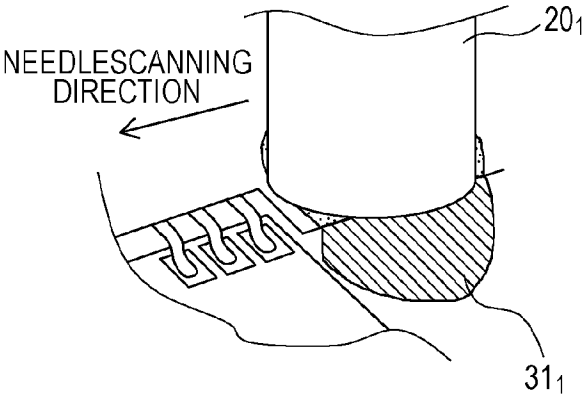

It is desirable to use a needle of which diameter is larger than the length of the side 11$b_1$ for the application of the sealing agent. A needle 20 of such a diameter covers the side 11$b_1$ when passing above the side 11$b_1$ as illustrated in FIG. 4, and partially protrudes from the side 11$a_1$ which perpendicularly intersects the side 11$b_1$. As illustrated in the perspective view of FIGS. 6A to 6C, when the sealing agent is discharged in a state in which the needle partially protrudes from the side 11$a_1$, the sealing agent may be applied to both the upper surface (i.e., the principal surface) of the electrical wiring member and the lower side of the electrical wiring tape via the side 11$a_1$. That is, the needle is moved in a state in which the sealing agent partially hangs down from the end surface of the electrical wiring tape (11$a_1$). As illustrated in FIG. 5, the sealing agent 31 applied from the end surface of the side 11$a_1$ to the lower side of the electrical wiring tape is made to abut the side surface of the recording element board 1 and is placed on the principal surface of the recording element board as the needle is moved. In this manner, formation of the recess on the principal surface of the recording element board 1 may be prevented.

Figure 6C:
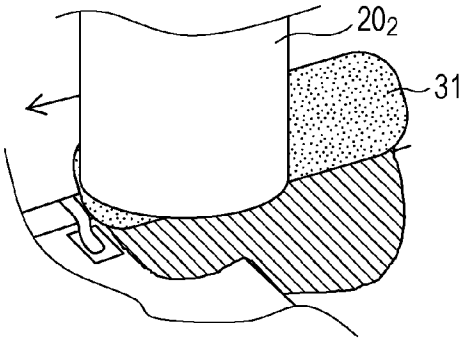
Figure 7A:
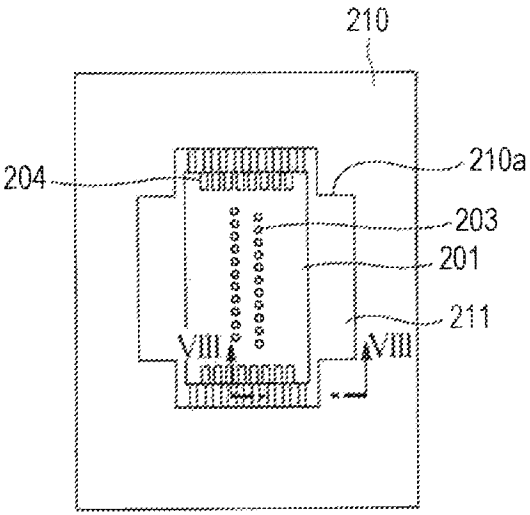
FIGS. 7A to 7C are schematic diagrams of an electrical wiring section in a related art liquid ejection head.
Figure 7B:
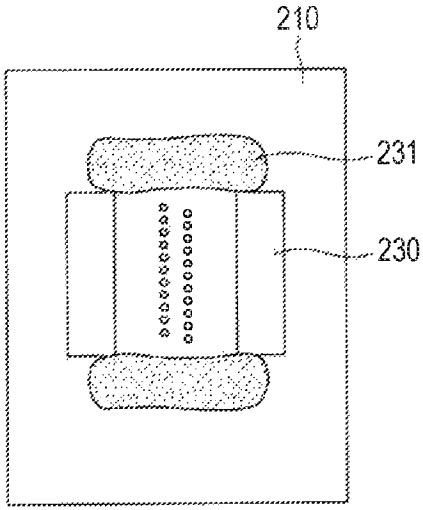
PRIOR ART FIG. 7B
Figure 7C:
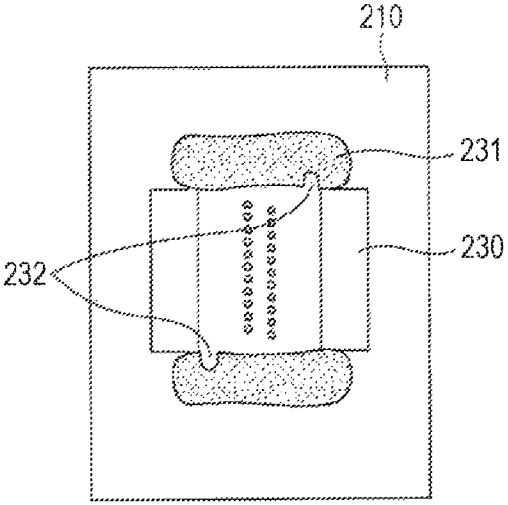
PRIOR ART FIG. 7C
Figure 8:
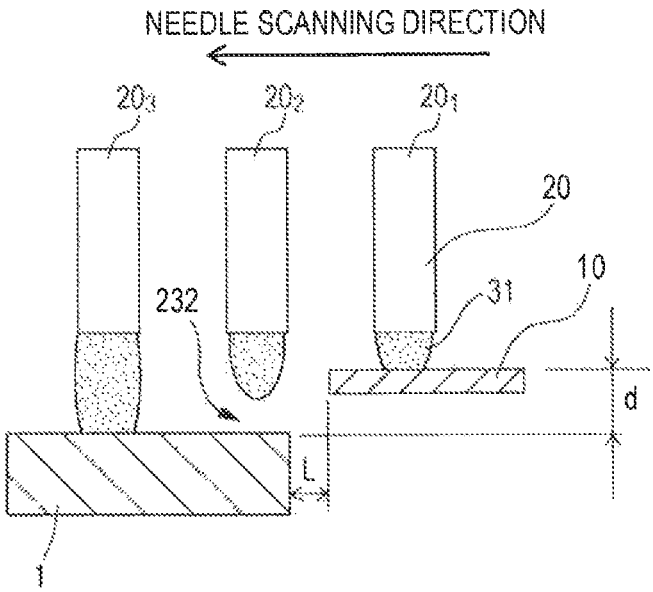
FIG. 8 is a diagram illustrating application of a sealing agent in the related art liquid ejection head.
Figure 9A:
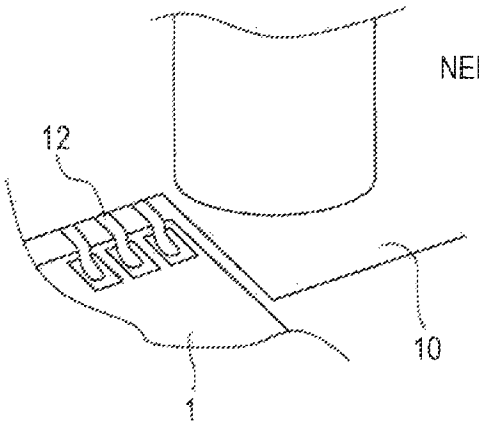
FIGS. 9A to 9C are perspective views illustrating steps of application of the sealing agent in the related art liquid ejection head.
Figure 9B:
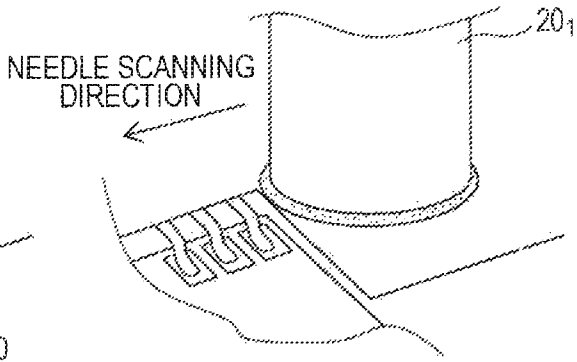
PRIOR ART FIG. 9B
Figure 9C:
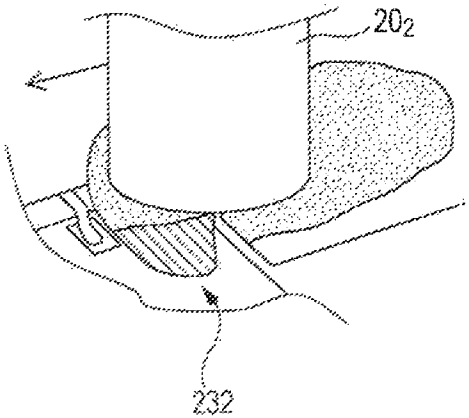
PRIOR ART FIG. 9C
Figure 10:
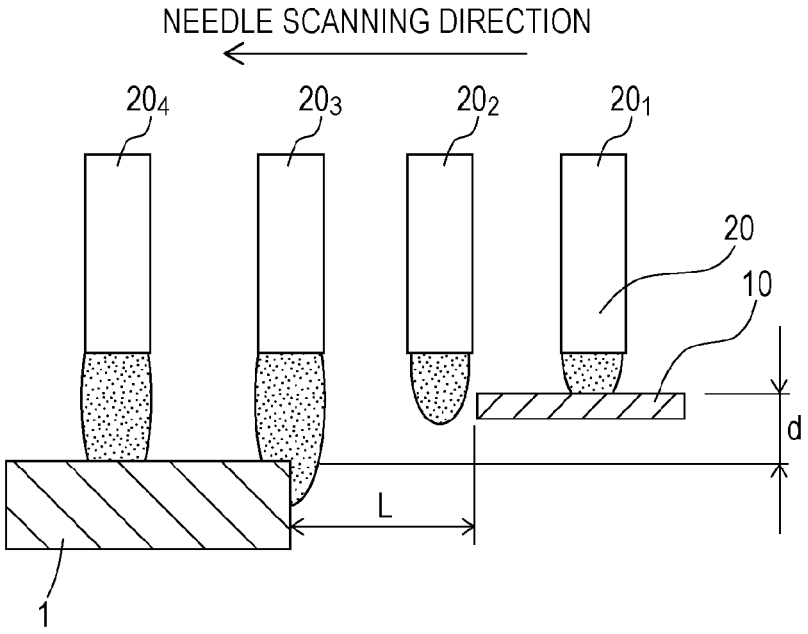
FIG. 10 is a diagram illustrating application of the sealing agent in the related art liquid ejection head.

The length Y1 of the side 11$b_1$ is not particularly limited. However, if the length Y1 is excessively long, the sealing agent disposed on the principal surface from the side surface of the recording element board 1 may cover discharge nozzles 3 on the recording element board 1 as illustrated in FIG. 6C and may disturb ejection of the liquid. It is therefore desirable that the length Y1 is determined so as not to reach the nozzles. A case in which Y1=0, i.e., the side 11*a* and the side 11$a_1$ are arranged on the same line will be described hereinafter. In this case, there is a possibility that the sealing agent which covers the pieces of electrical wiring 12 is drawn toward the sealing agent hanging down below the wiring tape from the end surface of the side 11$a_1$ and slips down. As a result, the shape of the sealing agent is not stabilized. Therefore, it is desirable that the length Y1 is longer than zero. It is desirable that the side 11$a_1$ of the electrical wiring tape is located such that an extension line of the side 11$a_1$ passes above the electrode section as illustrated in FIG. 3A. It is desirable that the side 11$a_2$ of the electrical wiring tape is located such that an extension line of the side 11$a_2$ passes along a position further toward the center of the recording element board than the electrode section 2.

Although not indispensable in the present invention, pieces of dummy wiring 14 may be provided as alternative means to stabilize the shape of the sealing agent which covers the electrical wiring 12. The pieces of dummy wiring 14 are disposed at both outer side of the plural pieces of electrical wiring 12 and form foundations to prevent slipping down of the sealing agent and stabilize the shape of the sealing agent when the electrical wiring 12 is sealed with the sealing agent. Since the sealing agent is applied continuously to the side 11$b_1$, the piece of dummy wiring and the pieces of electrical wiring and thus the shape of the sealing agent is stabilized, it is desirable that the length Y1 of the side 11$b_1$ is the same or longer than that of the piece of dummy wiring.

The length Y2 of the side 11$b_2$ which faces the side 11$b_1$ is not particularly limited, but is desirably determined such that the needle is located at a position at which the needle does not protrude from the side 11$a_2$ of the electrical wiring tape. If the length Y2 is determined such that the needle is located at a position at which the needle protrudes from the side 11$a_2$ of the electrical wiring tape, hanging down of the sealing agent from the end surface of the side 11$a_2$ of the electrical wiring tape also occurs at the side 11$b_2$. In this case, there is a possibility that the sealing agent which is disposed on the principal surface of the recording element board 1 and covers the electrical connecting portions 12*a* is drawn toward the sealing agent hanging down below the electrical wiring tape and the sealing agent may slip down from the side surface of the recording element board 1. Therefore, the shape of the sealing agent is not stabilized. It is therefore desirable that the length Y2 is determined such that the needle does not protrude from the side 11$a_2$ of the electrical wiring tape. Even if the needle is located at a position at which the needle protrudes from the side 11$a_2$, the amount of the sealing agent which slips down may be reduced if the length Y2 of the side 11$b_2$ is longer than the length Y1 of the side 11$b_1$.

In an alternative configuration of the present embodiment described above, an increased amount of the sealing agent 231 is made to be discharged from the needle to reduce the formation of the recess 232. In this case, however, since the height of the applied sealing agent 231 is still higher, the distance between the ejection ports 203 and the recording medium needs to be increased to avoid contact. This is not desirable because precision in landing of the ejected ink droplets on the recording medium decreases and thus the image quality deteriorates.

Alternatively, the viscosity of the sealing agent 231 may be lowered significantly. In this case, however, an application area (i.e., a sealing area) of the sealing agent 231 is increased, whereby the sealing agent 231 flows into and covers the ejection ports 203.

If the viscosity of the sealing agent 231 is lowered, the thickness of the sealing agent 231 is reduced, whereby sealing performance is impaired. There is therefore a possibility that the liquid enters the electrical connecting portions and causes, for example, corrosion of the pieces of electrical wiring 212.

EXAMPLE

An example will be described hereinafter. A liquid ejection head is prepared in which an electrical wiring tape of the following diameter is used: the length Y1 of the side 11$b_1$ is 0.4 mm and the length Y2 of the side 11$b_2$ is 0.8 mm. The width of the step d between the principal surface 1*a* of the recording element board 1 and the principal surface 10*a* of the electrical wiring tape 10 is 0.2 mm and the gap L between the side 11$b_1$ and the recording element board is 0.2 mm. A sealing agent of 238 Pa·s is applied to the liquid ejection head. The sealing agent is applied while a needle is positioned to partially protrude from the electrical wiring tape. The needle is moved from the side 11$b_1$ toward the opposite side 11$b_2$ passing above the step d and the gap L and above the electrical connecting portion 12*a* while discharging the sealing agent on both an upper surface of the electrical wiring tape and a lower side of the electrical wiring tape.

When the sealing agent is disposed in the manner as described above, no recess is formed and the sealing is performed desirably. The result is shown in Table.

Comparative Example

Ahead is prepared in which an electrical wiring tape of the following diameter is used: the length Y1 of the side 11$b_1$ is 0.8 mm and the length Y2 of the side 11$b_2$ is 0.8 mm. The width of the step d between the principal surface 1*a* of the recording element board 1 and the principal surface 10*a* of the electrical wiring tape 10 is 0.2 mm and the gap L between the side $\mathbf{11}b_1$ and the recording element board is 0.2 mm. A sealing agent of 238 Pa·s is applied by the liquid ejection head. The sealing agent is applied while the needle is positioned not to protrude from the electrical wiring tape. The needle is moved from the side $\mathbf{11}b_1$ toward the opposite side $\mathbf{11}b_2$ passing above the step d and the gap L and above the electrical connecting portion 12*a* while discharging the sealing agent on the upper surface of the electrical wiring tape but not on the lower side of the electrical wiring tape. When the sealing agent is disposed in the manner as described above, a recess is formed as shown in Table.

TABLE

| | Example | Comparative Example |
|---|---|---|
| Sealing agent on lower side of wiring tape | Applied | Not applied |
| Result | A | B |

Result
A: no recess is formed on the recording element board
B: recess is formed on the recording element board While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-126280 filed Jun. 6, 2011, which is hereby incorporated by reference herein in its entirety.

What is claimed is:

1. A method of manufacturing a liquid ejection head, comprising:

preparing a liquid ejection head, the liquid ejection head comprising:

a recording element board provided with an ejection port through which liquid is ejected, an energy generator which produces energy that causes ejection of the liquid, an electrical wiring member provided with an opening from which the recording element board is exposed, and plural electrical connecting portions for electrically connecting the recording element board and the electrical wiring member, wherein the electrical wiring member is disposed at a position higher than a surface of the recording element board on which the ejection port is formed, the plural electrical connecting portions being arranged in a predetermined direction on the recording element board;

relatively moving a discharge member for dropping a sealing agent toward one end of the arrangement of the electrical connecting portions while dropping the sealing agent onto the electrical wiring member and inside the opening, wherein the electrical wiring member includes a convex portion disposed on one end of the opening and protruding toward the recording element board, and the sealing agent is dropped into the opening from an end of the convex portion in a direction intersecting the direction in which the plural electrical connecting portions are arranged; and relatively moving the discharge member from the one end of the arrangement of the electrical connecting portions to the other end while dropping the sealing agent from the discharge member to seal the electrical connecting portion.

2. The method of manufacturing a liquid ejection head according to claim 1, wherein the electrical connecting portions are portions at which electrode sections formed in the recording element board and pieces of electrical wiring extending inside the opening from the electrical wiring member are connected to each other.

3. The method of manufacturing a liquid ejection head according to claim 1, wherein one side of two sides, which face each other via the electrode section of the electrical wiring member that define the opening, is shorter than the other.

4. The method of manufacturing a liquid ejection head according to claim 3, wherein an extension line of a line which is continued from the one of the mutually facing sides is formed along a direction in which the discharge member, is moved passes over the electrode section.

5. The method of manufacturing a liquid ejection head according to claim 3, wherein an extension line of a line which is continued from the other of the mutually facing sides is formed along a direction in which the discharge member, is moved passes at a position nearer the center of the recording element board than the electrode section.

6. The method of manufacturing a liquid ejection head according to claim 1, wherein the discharge member is moved toward the one end and the sealing agent dropped inside the opening comes in contact with a side surface of the one end of the recording element board.

7. The method of manufacturing a liquid ejection head according to claim 1, wherein the electrical connecting portions are formed at one end and the other end opposite to the one end of the recording element board.

* * * * *